United States Patent [19]

Goller et al.

[11] Patent Number: 4,791,793

[45] Date of Patent: Dec. 20, 1988

[54] DEVICE FOR THE OFFSET CONTROL OF THE NEEDLE BEDS OF A FLAT-BED KNITTING MACHINE

[75] Inventors: Ernst Goller, Reutlingen; Jürgen Ploppa, Pfullingen; Bertram Glaumer, Reutlingen, all of Fed. Rep. of Germany

[73] Assignee: H. Stoll GmbH & Co., Fed. Rep. of Germany

[21] Appl. No.: 92,545

[22] Filed: Sep. 3, 1987

[30] Foreign Application Priority Data

Sep. 10, 1986 [DE] Fed. Rep. of Germany ..... 3630818

[51] Int. Cl.[4] ..... D04B 7/00

[52] U.S. Cl. ..... 66/69

[58] Field of Search ..... 66/69

[56] References Cited

FOREIGN PATENT DOCUMENTS

| | | | |
|---|---|---|---|
| 2938388 | 4/1981 | Fed. Rep. of Germany | 66/69 |
| 209486 | 9/1984 | German Democratic Rep. | 66/69 |
| 60-167957 | 8/1985 | Japan | 66/69 |

*Primary Examiner*—Ronald Feldbaum
*Attorney, Agent, or Firm*—Jones, Tullar & Cooper

[57] ABSTRACT

A device for the offset control of the needle beds of a flat-bed knitting machine has a servomotor for the adjustment of one of the needle beds in relation to the other and has a position control circuit controlling the servomotor. So that it is possible in such a device, after an unintentional shut-down of the machine during knitting, to exactly reconstruct or reset the original or the about to be set position of the movable needle bed without damaging the knitted fabric present in the machine just produced, an actual value transducer device performing a set point/actual value comparison is provided, having an incremental transducer, the high resolution and accuracy of which is many times finer than the needle gauge and which aditionally has reference marks at least at the interval of the needle gauge of the needle bed but with the same high degree of accuracy, and an absolute value transducer, the resolution of which is at least the same as, preferably higher than the distance of the reference marks of the incremental transducer.

11 Claims, 2 Drawing Sheets

DEVICE FOR THE OFFSET CONTROL OF THE NEEDLE BEDS OF A FLAT-BED KNITTING MACHINE

FIELD OF THE INVENTION

The present invention relates to a device for the offset control of the needles beds of a flat-bed knitting machine with a servomotor for offsetting one of the needle beds in relation to the other and with a position control circuit controlling the servomotor.

BACKGROUND OF THE INVENTION

Offsetting the needle beds in relation to each other is performed by, for example, a mechanical cam control at the time the carriages are in the reversing position at the ends of the needle beds. Both needle beds are moved towards each other. Offset takes place either by a set amount of the needle gauge of the needle bed in the form of a so-called racking for transfer or by one or more needle gauges in the form of a so-called entire needle offset for the production of particular patterns such as, for example, a braided pattern.

In more recent developments a change has been made from the purely mechanical cam control to an electrical offset control by means of a servomotor, at the same time moving only one of the needle beds. Such a device for the offset control of the needle beds of flat-bed knitting machines is known from German Laid-open Patent applications DE-OS No. 2938 388 and DE-OS No. 30 26 381. In the first of these known devices a zero transducer is used which only emits a signal if the zero offset positions has been attained as the center position. Nothing is directly mentioned in the second known device about a comparison of the set point value with the actual value.

If the flat-bed knitting machine, for whatever reasons, was intentionally or unintentionally turned off during the production of knitted fabric and now must be started again, and if during this period the offset of the respective needle bed either took place or was controlled, the problem arises of knowing where the servomotor or the movable needle bed were at this time. For reasons of a possible break of the fabric just being knitted it is not possible to return the movable needle bed into a zero position and to attain from here the desired set point value. Such a movement of the movable needle bed across several gauges would lead to tearing of the knitted fabric and damage to the needles.

SUMMARY OF THE INVENTION

It is therefore an object of the present invention to provide a device for the offset control of the needle beds of flat-bed knitting machines of the type mentioned above by means of which it is possible, after an unintentional shut-down of the machine during knitting, to exactly reconstruct or reset the original or the about to be set position of the movable needle bed without damaging the knitted fabric present in the machine and just produced.

This object is attained in a device for the offset control of the needle beds of flat-bed knitting machines of the type mentioned by the fact that an actual value transducer device performing a set point/actual value comparison is provided, having an incremetal transducer, the high resolution and accuracy of which is many times finer than the needle gauge and which additionally has reference marks at least at the interval of the needle gauge of the needle bed but with the same high degree of accuracy, and an absolute value transducer, the resolution of which is at least the same as, preferably higher than the distance of the reference marks of the incremental transducer.

It is possible with the aid of the present invention to reconstruct in an absolutely exact manner and within a narrow range the originally selected and to be reset offset in which the respective needle bed had stopped or run out. Since the rough gauge, for example within the range of the needle gauge, can be performed by a simple and cheaply manufactured analog or digital absolute value transducer and the fine gauge within its resolution range by an incremental transducer of very high resolution and accuracy (in the μm range), the needle bed only needs to be moved within a small area, for example within a single needle gauge, to reconstruct its position. For this operation the absolute value transducer provides the respective "address" of the needle gauge with the aid of the reference marks of the incremental transducer, thus making it possible by moving the needle bed back and forth to the respectively nearest reference mark, which can be determined by the absolute value transducer, to again attain the exact set point position with the help of the incremental transducer. The steps of the invention make this possible in a cost-effective range, because such analog or digital absolute value transducers can be manufactured relatively cheaply, since they need only a comparatively low resolution in the range of about or somewhat less than a needle gauge (for example 1 mm). Digitalized absolute value transducers having a higher resolution, such as required by an incremental transducer (of about 2/100 mm), would be much too expensive, especially since they would have to cover a relative wide range of several needle gauges. In other words, the invention combines an incremental transducer of high accuracy and resolution in the μm range, having references marks per needle gauge of equal accuracy in the μm range, with an analog or digital absolute value transducer, the resolution of which must lie within the reference mark interval or the needle gauge.

The transducer heads of the absolute value transducer and the incremental transducers insure that the transducers are not influenced by the considerable forces acting between the offset device and the needle bed.

The transducer heads of the absolute value transducer and the incremental transducer are fixed to the same connecting element rigidly connected to the needle bed. This insures that the transducers' heads are moved evenly without unacceptable movement tolerances, since they act on the same butt position. The transducer elements of the absolute value transducer and the incremental transducer are spatially associated with each other and are disposed parallel to each other.

An adjusting nut rigidly connected to a needle bed by a connecting strip is provided to obtain a transfer of the movements of the respective needle bed to the transducer heads free of play and distortions of the adjustment device in a construction known from German Laid-open Patent Application DE-OS No. 30 26 381.

In accordance with advantageous exemplary embodiments an analog absolute value transducer in the form of a linear potentiometer or a linear digital absolute value transducer of low resolution is provided, which is very cost-effective, and the incremental transducer has an optical glass measuring rod of high precision. The digital or digitalized values emitted by the transducers are supplied to a computing unit in which the correspondence of the respective reference marks of the incremental transducer to the "address" of the needle gauge or the needles in the needle bed is stored and which performs the comparison between a set point and an actual value and controls the servomotor accordingly.

Further details of the invention can be seen in the following description in which the invention is further described and explained by means of the exemplary embodiment shown in the drawings.

DETAILED DESCRIPTION OF THE PREFERRED EMBODIMENT

Figure 1:
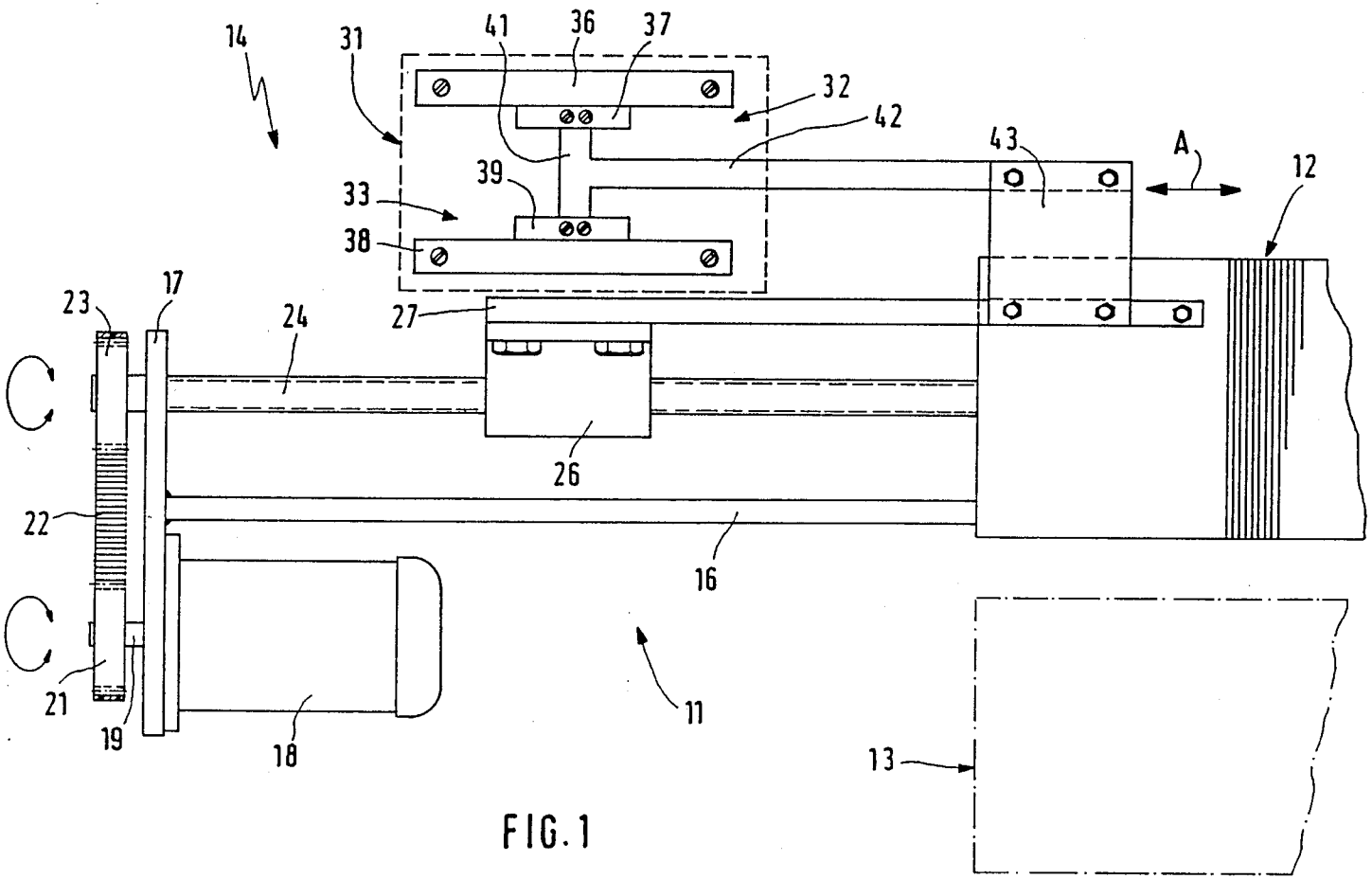
FIG. 1 is a schematic top view of a device for the offset control of one needle bed in relation to the other needle bed in a flat-bed knitting machine in accordance with a preferred embodiment of the present invention.

The device 11 in accordance with a preferred embodiment of the present invention, particularly shown in FIG. 1, is used to control the offset of needle beds 12, 13 of a flat-bed knitting machine 14 relative to each other. In the exemplary embodiment shown, the rear needle bed 12 can be offset or moved in the direction of the double arrow A in relation to the front needle bed 13, only indicated by dash-dotted lines. In FIG. 1, the arrangement of the needle beds 12 and 13 is shown in a top view and thus in a plane, it being understood that the needle beds 12 and 13 can either be arranged in a V shape in case of a corresponding flat-bed knitting machine or in a plane, for example in case of a Links-Links flat-bed knitting machine.

In accordance with FIG. 1 a support frame 16, on which the rear needle bed 12 and, in a manner not shown, also the front needle bed 13 is attached, is elongated in the direction of one side of the needle bed 12 and has on its free end a laterally extending support plate 17, on one end of which a servomotor 18 is flanged. The motor 18 can be any optional servomotor, for example an AC servomotor, DC motor of the like. A drive shaft 19 of the servomotor 18 is connected fixed against relative rotation with a first crown gear 21, which is disposed on the side of the support plate 17 facing away from the servomotor 18. The first crown gear 21 is connected via a toothed belt 22 with a second crown gear 23, which is disposed on the support plate 17 on the same side of the support plate 17 as the first crown gear 21, but on the end of the support frame 16 facing away from the servomotor 18. The second crown gear 23 is connected fixed against relative rotation with one end of a threaded spindle 24 which is pivotably supported at this end in the support plate 17 and at the other, opposite end in a manner not shown in the support frame 16 below the rear needle bed 12. An adjusting nut 26, prestressed without play, interacts with the threaded spindle 24 and is non-rotatably supported on the threaded spindle 24 but movable back and forth in the direction of the double arrow A. An adjusting or offset strip 27 is fixedly flanged with its one end to the adjusting nut 26, the other end of the adjusting strip 27 being fixedly connected with the rear needle bed 12 which is to be adjusted. In this manner the rear needle bed 12 can rigidly, i.e., without play, follow the back and forth movements of the adjusting nut 26.

The device 11 further has an actual value transducer device 31 with an analog absolute value transducer 32 and an incremental transducer 33. The absolute value transducer 32 is in the form of a linear potentiometer and consists of a fixed part 36 in the form of an electrical resistor, fastened to the support frame 16 in a manner not shown, and of a transducer head 37 in the form of a potentiometer tap, movable back and forth in accordance with the double arrow A. The incremental transducer 33 consists of a part 38 in the form of an optical glass measuring rod with a fine grating gauge in the range of 20 μm and reference marks at the intervals of, for example, a needle gauge, fixedly marks at the intervals of, for example, a needle gauge, fixedly supported on, for example, the support frame 16, and of a transducer head 39, movable back and forth in accordance with the double arrow A. The two fixed parts 36 and 38 are disposed parallel to each other and have a set, spatially fixed predetermined correspondence. The two transducer heads 37 and 39 are fastened to the transverse end 41 of a horizontally disposed T-shaped connecting strip 42, the end of which away from the transducer heads is fastened to a connecting plate 43. This connecting plate 43 is directly fastened to the rear needle bed 12 with its end away from the connecting strip 42. In this manner the transducer heads 37 and 39 are directly and rigidly connected with the rear needle bed 12, which is to be adjusted, so that the forces acting on the needle bed cannot influence the actual value transducer device 31.

Figure 2:
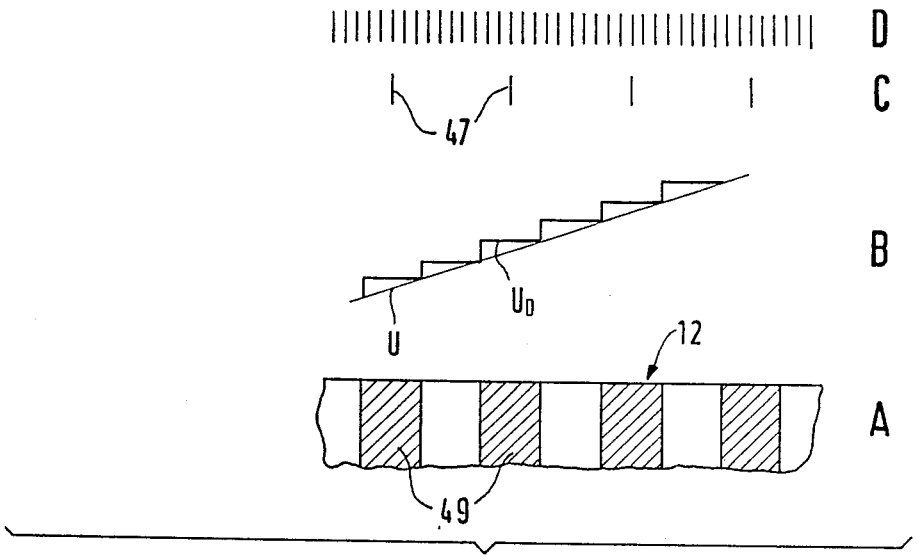
FIG. 2 is a schematic view of the pulses emitted by the actual transducer device in correspondence with the needle gauge.

As shown in FIG. 2, the analog absolute value transducer 32 is used to identify the separate reference mark signals emitted by the incremental transducer 33, which follow each other successively at a distance of, for example, a needle gauge, along the distance of the entire offset path. This is done such that, proceeding from an initial position, for example the maximum offset position in one direction, and thus proceeding from a set voltage sensed by the linear potentiometer, the sensed voltage U increases linearly during the offset movement, as shown in FIG. 2B. If this linear initial voltage curve U is digitized in the A/D converter 46 shown in FIG. 3, discrete values $U_D$ are obtained as shown in FIG. 2B by the step pattern. The resolution in the form of these discrete values is relatively small, however, as it must be finer than the intervals of the reference marks of the incremental transducer 33. In the example shown, the resolution given by the absolute value transducer is approximately twice as small (better) than the intervals of the reference marks of the incremental transducer 33. In other words, within the range of the maximally possible offset path between the two needle beds 12 and 13 a discrete initial value, i.e., a reference mark 47 of incremental transducer 33 which is identified by the absolute value transducer 32, can be associated with each needle 49 in the rear needle bed 12. This correspondence of individual reference marks 47 to a respectively associated needle 49 in the needle bed 12 is stored in a computing unit 48 (FIG. 3).

To achieve exact placement of the needle beds 12 and 13 in reference to each other or of the offset of the rear needle bed 12 to the front needle bed 13 in the μm range, the incremental transducer 33 is provided, which has a resolution and accuracy many times higher than the absolute value transducer 32. This is made schematically clear by FIG. 3D in comparison to the reference marks 47 of FIG. 3C. For example, the needle gauge is on the order of 2 mm, so that a reference mark 47 appears every 2 mm, while the resolution of this incremental transducer 33 in accordance with the schematic view in FIG. 3D is around 0.2 mm, in actuality, however, it is higher by the power of ten, i.e., 20$\mu$.

Figure 3:
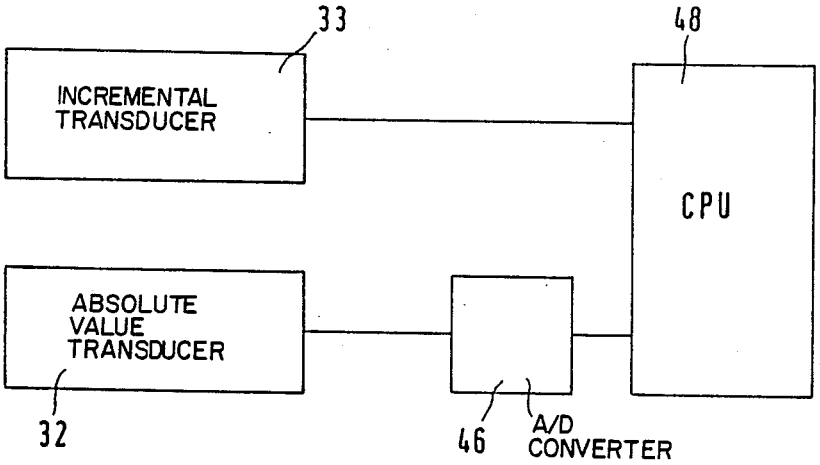
FIG. 3 is a block diagram to show the processing of the signal emitted by the actual value transducer device.

FIG. 3 shows that the object of the incremental transducer 33 is connected directly and the output of the absolute value transducer 32 is connected via the A/D converter 46 with the computing unit 48, in which the coordination of the individual reference marks 47 with the individual needles in the needle bed 12 in the above identified offset range, as well as the spatial association of the two transducers 32 and 33 in relation to each other, is stored and which, as a part of a not further shown position control circuit, correspondingly controls the servomotor 18 in response to the set point value and after comparison with the actual value.

In the flat-bed knitting machine 14 is unpredictably shut off for any reason, for instance because of a voltage loss during the knitting operation, it must be possible to determine after it is turned on again where the needle bed 12, which is to be offset or has been offset, is located in relation to the other needle bed 13 or to where it should be offset in accordance with the set point value of the program. Since a value-related association of each reference mark 47 to a particular needle has been made by the absolute value transducer 32, it is only required to move the movable needle bed 12 to an adjacent reference mark 47, for which an offset path of maximally less than one needle gauge is required. Since the reference mark 47 which has been reached exactly defines the position of a particular needle in the needle bed known by its number, it is possible to move, starting from this reference mark 47 and after it has been associated by the computing unit 48 with a particular increment in the incremental transducer 33, exactly to the desired offset position. This type of movement or identification of the offset set point position takes place over the shortest distance and therefore without damage to the knitted fabric which was started.

It is understood that, if the needle beds 12 and 13 are provided in a V-shaped arrangement, the actual value transducer device 31, the servomotor 18 and the first crown gear 21 with the toothed belt 22 are disposed in a corresponding manner in a V-shaped arrangement with the threaded spindle 24 or the support frame 16.

The absolute value transducer 32 can be of the digital linear type instead of analog.

It is further to be understood that the exemplary embodiment described above has been shown by way of example only and that further variants and improvements are possible with the scope of the invention.

What is claimed is:

1. A device for the offset control of the needle beds of a flat-bed knitting machine, comprising:

servomotor means connected to one of the needle beds for offsetting one needle bed relative to another needle bed; and a position control circuit connected to said one needle bed and to said servometer means for controlling the servomotor, said position control circuit including an actual value transducer device for providing a set point/actual value comparison; said actual value transducer device including:

a high resolution incremental transducer, the high resolution of which is many times finer than the needle gauge of the needles of the needle beds, said incremental transducer having reference marks corresponding at least to the needle gauge intervals of the needle beds; and an absolute value transducer the resolution of which is at least the same as, but preferably higher than the distance of the reference marks of the incremental transducer.

2. The device as defined in claim 1, wherein the incremental transducer and the absolute value transducer each have a transducer head connected directly to said one needle bed.

3. The device as defined in claim 2, wherein the incremental transducer and the absolute value transducer element each has affixed transducer element which are spatially associated with each other and disposed parallel to each other.

4. The device as defined in claim 2, further comprising:

a connecting element rigidly connected to said one needle bed at one of its ends and to each transducer head at its other end.

5. The device as defined in claim 4, wherein the incremental transducer and the absolute value transducer each has a fixed transducer element which are spatially associated with each other and disposed parallel to each other.

6. The device as defined in claim 1, further comprising:

a spindle connected to and driven by said servomotor means;

an adjusting nut adjustably mounted on said spindle, said adjusting nut being pre-stressed without play;

an adjusting strip connected to the adjusting nut and rigidly to said one needle bed; and a connecting element, wherein:

the incremental transducer and the absolute value transducer each have a transducer head connected directly to said one needle bed; and the connecting element is rigidly connected to said one needle bed at one of its ends and to each transducer head at its other end.

7. The device as defined in claim 1, wherein the absolute value transducer comprises an analog absolute value transducer in the form of a linear potentiometer.

8. The device as defined in claim 1, wherein the absolute value transducer comprises a digital linear absolute value transducer with low resolution.

9. The device as defined in claim 1, wherein the incremental transducer includes a fixed part comprising an optical glass measuring rod.

10. The device as defined in claim 1, wherein said position control circuit further includes a computing unit to which the incremental transducer and the absolute value transducer are connected directly.

11. The device as defined in claim 1, wherein said position control circuit further includes a computing unit and an A/D converter connected to the computing unit, and wherein the absolute value transducer is connected to the A/D converter and the incremental transducer is corrected directly to the computing unit.

* * * * *